United States Patent [19]

Heumann et al.

[11] 4,055,504

[45] Oct. 25, 1977

[54] STABILIZER IN A HIGH VOLTAGE INSULATION ON A POLYOLEFIN BASE

[75] Inventors: Heinz Heumann, Rheydt; Manfred Saure, Kassel; Heinz Wagner, Fuldatal; Johann Wartusch, Vellmar, all of Germany

[73] Assignees: Licentia Patent-Verwaltungs-G.m.b.H., Frankfurt am Main; Aeg-Telefunken Kabelwerke Aktiengesellschaft, Rheydt, both of Germany

[21] Appl. No.: 685,539

[22] Filed: May 12, 1976

[30] Foreign Application Priority Data

May 17, 1975 Germany ..... 2522200

[51] Int. Cl.[2] ..... H01B 3/30; H01B 3/24

[52] U.S. Cl. ..... 252/63.2; 252/63.7; 252/66

[58] Field of Search ..... 252/66, 63.2, 63.7; 174/110 SR, 110 PM, 110 FC; 260/45.7 R, 45.9 R, 45.7 S

[56] References Cited

U.S. PATENT DOCUMENTS

| | | | |
|---|---|---|---|
| 3,350,312 | 10/1967 | Gross et al. | 252/66 X |
| 3,482,033 | 12/1969 | Kenney et al. | 174/110 PM X |
| 3,542,684 | 11/1970 | Hunt | 252/63.2 |
| 3,629,110 | 12/1971 | Hunt | 252/66 X |
| 3,649,542 | 3/1972 | Hasebe et al. | 252/63.2 X |
| 3,674,695 | 7/1972 | Wuerstlin et al. | 252/63.2 |

FOREIGN PATENT DOCUMENTS

| | | |
|---|---|---|
| 1,141,081 | 12/1962 | Germany |

*Primary Examiner*—Harris A. Pitlick
*Attorney, Agent, or Firm*—Spencer & Kaye

[57] ABSTRACT

A high voltage insulation polyolefin base is provided with a stabilizing amount of a wetting agent containing a perfluoro-alkyl group as a stabilizer to improve the voltage stability of the polyolefin base.

12 Claims, No Drawings

STABILIZER IN A HIGH VOLTAGE INSULATION ON A POLYOLEFIN BASE

BACKGROUND OF THE INVENTION

The present invention relates to the stabilization of a high voltage insulation having a polyolefin base, and more particularly to a stabilizer for cross-linked polyethylene insulation.

It is known to provide a high voltage insulation made of a polyolefin base with stabilizing additives. Stabilizing agents are known which become active against oxidizing influences, as well as those which become active against the formation of discharge channels as a result of increased electrical field stresses. The known stabilizers, however, often are lacking with respect to workability and effectiveness in the insulation.

Stabilizing additives in insulations are known with which it is desired to reduce the problems of workability. Attempts have been made to use stabilizer additives which are compatible with the insulation, but which have low solubility. The working of such additives, however, still has drawbacks which do not provide an assurance of obtaining a homogeneous insulation.

SUMMARY OF THE INVENTION

It is a primary object of the present invention to improve, by way of stabilizing additives, the efficiency of polyolefin insulations against increased electrical field stresses and against the resulting formation of discharge channels called "treeing."

Additional objects and advantages of the present invention will be set forth in part in the description which follows and in part will be obvious from the description or can be learned by practice of the invention. The objects and advantages are achieved by means of the processes, compositions and combinations particularly pointed out in the appended claims.

To achieve the foregoing objects, and in accordance with its purposes, the present invention, as embodied and broadly described, provides a high voltage polyolefin insulation having a stabilizing amount of a wetting agent containing a perfluoroalkyl group as a stabilizer to improve the voltage stability of the polyolefin insulation.

It is to be understood that both the foregoing general description and the following detailed description are exemplary, but are not restrictive of the invention.

DETAILED DESCRIPTION OF THE INVENTION

The wetting agent used in the present invention contains a perfluoro-alkyl group. Generally, the wetting agent will contain from 10 to 50 weight percent of such group. The perfluoro-alkyl group that is in the wetting agent generally contains 1 to 10, and preferably 2 to 5 carbon atoms. Such wetting agents are commercially available as fluorized liquid wetting agents, e.g. marketed under the trade name —FC— 170 by 3 M-Company, Minnesota Mining and Manufacturing Company.

A preferred wetting agent for use in the practice of the present invention is a sulfonamide-ethylene oxide adduct containing a perfluoro-alkyl group. The ethylene oxide component of the wetting agent may contain about 10–60% by weight.

The amount of perfluoro-alkyl containing wetting agent may be varied within wide limits, and even small amounts of this wetting agent are effective. To attain homogeneous distribution, quantitites of perfluoro-alkyl containing wetting agents of up to 1% or even more can be used. Generally, for most applications, there are used amounts varying from about 0.05 to 1% by weight of perfluoro-alkyl containing wetting agent, with respect to the polyolefin to be stabilized, and preferably 0.1 to 0.5% by weight of perfluoro-alkyl containing wetting agent.

The perfluoro-alkyl containing additives used in the present invention can effectively be combined with other known stabilizing agents. Particularly suited for this purpose are low viscosity, aromatic hydrocarbon mixtures in which the additives of the present invention are easily soluble. With such a combination the wetting capability of the stabilizing additives in cavities or on foreign bodies in the insulation can be improved. Examples of such substances are naphthalene, anthracene, fluorene and other aromatic hydrocarbons. A preferred mixture for use as a further additive comprises a mixture of an aromatic ketone with an aromatic containing hydroxyl compound, e.g. 0.5% by weight of acetophenone and 1.5% by weight cumyl alcohol.

The additives of the present invention are particularly effective with polyolefins such as low density polyethylene based compositions which generally have a density on the order of 0.92 to about 0.95 and a melt index between 0.2 and 2.0. Specifically, the polyethylenes to which we refer are those solid polymers of ethylene prepared by "high pressure" process. Additionally, the additives can be used with polyethylene compositions which have been cross-linked, using, for example, a peroxide catalyst, e.g., dicumyl peroxide.

The wetting agents are mixed in when the polyolefin is compounded.

For insulations of cross-linked polyethylene, the perfluoroalkyl containing additives of the present invention can simultaneously increase the stabilizing effect of the fission products acetophenone and cumyl alcohol produced during the cross-linking of polyethylene with dicumyl peroxide.

The perfluoro-alkyl containing additives used in the present invention support the penetration of liquid stabilizing compounds into discharge channels formed in connection with the known treeing phenomena in polyethylene insulations or cross-linked polyethylene insulations, respectively. They act in the manner of a capillary-active substance. It has thus been observed that the discharge channels in an sample affected by treeing are filled more rapidly and completely with a migrating liquid when the perfluoro-alkyl containing wetting agents of the present invention are used.

In order to examine the efficiency of the perfluoro-alkyl containing wetting agents of the present invention in polyethylene, samples of cross-linked polyethylene were provided with defined channels by the insertion and removal of needles, and the level reached by liquids penetrating into the channel was measured in dependence on time. As shown by these experiments, a perfluoro-alkyl containing wetting agent according to the present invention, when added to the insulation in the amount of 0.4%, produces a doubling of the level to which the liquid penetrates in the channel. In the specific case under examination in the experiments, the liquid penetrating the channel was the fission products produced in the cross-linking process such as acetophenone and cumyl alcohol.

Further, the perfluoro-alkyl containing wetting agents according to the present invention provide improved wetting of foreign particles, or flaws, respectively, which in practice can usually not be avoided completely, with the surrounding insulating material so that the formation of discharge channels at these locations can be substantially eliminated.

The following example serves to illustrate the increased voltage stability achieved with voltage stabilizing additives in accordance with the present invention.

A test was made with polyethylene composition employing a low density polyethylene (0.92 specific gravity, 1.5 melt index), containing 0.5 percent by weight of voltage stabilizing additive (aromatic hydrocarbon of high boiling point) and 0.4 percent by weight of wetting agent according to the invention.

The voltage stabilizing effect of this composition, according to the single needle test described by D. W. Kitchin and D. S. Pratt (AJEE Transactions Paper No. 62-54/1962) has been shown by an increased tree inception voltage. While a polyethylene without stabilizing additive has a tree inception voltage of 10 KV, a stabilized composition according to the invention has a tree incept-voltage of more than 30 KV.

It will be understood that the above description of the present invention is susceptible to various modifications, changes and adaptations, and the same are intended to be comprehended within the meaning and range of equivalents of the appended claims.

What is claimed is:

1. A high voltage insulation polyolefin base having a stabilizing amount of a wetting agent as a stabilizer to improve the voltage stability of the polyolefin base, the wetting agent being a sulfonamide-ethylene oxide adduct having a perfluoro-alkyl group.

2. The insulation as defined in claim 1 including a low viscosity, aromatic hydrocarbon mixture as a further stabilizer.

3. The insulation as defined in claim 1 wherein the polyolefin is a cross-linked polyethylene and includes a further stabilizer comprised of a mixture of aromatic ketone and an aromatic containing hydroxyl compound.

4. The insulation as defined in claim 1 wherein the polyolefin is a cross-linked polyethylene.

5. The insulation as defined in claim 1 wherein the perfluoro-alkyl group contains 1 to 10 carbon atoms, and the wetting agent contains 10 to 50 weight percent of such group.

6. The insulation as defined in claim 5 wherein the ethylene oxide component of the wetting agent comprises 10 to 60% by weight.

7. A process for stabilizing a high voltage insulation polyolefin base comprising adding a stabilizing amount of a wetting agent as a stabilizer to improve the voltage stability of the high voltage insulation, the wetting agent being a sulfonamide-ethylene oxide adduct having a perfluoro-alkyl group.

8. The process as defined in claim 7 wherein the wetting agent is combined with a low viscosity, aromatic hydrocarbon mixture as a further stabilizer.

9. The process as defined in claim 7 wherein the polyolefin is a cross-linked polyethylene and includes a further stabilizer comprised of a mixture of an aromatic ketone and an aromatic containing hydroxyl compound.

10. The process as defined in claim 7 wherein the polyolefin is a cross-linked polyethylene.

11. The process as defined in claim 7 wherein the perfluoro-alkyl group contains 1 to 10 carbon atoms, and the wetting agent contains 10 to 50 weight percent of such group.

12. The process as defined in claim 11 wherein the ethylene oxide component of the wetting agent comprises 10 to 60% by weight.

* * * * *